US005338658A

United States Patent [19]

Hirano

[11] Patent Number: 5,338,658

[45] Date of Patent: Aug. 16, 1994

[54] SILVER HALIDE PHOTOGRAPHIC MATERIALS

[75] Inventor: Shigeo Hirano, Kanagawa, Japan

[73] Assignee: Fuji Photo Film Co., Ltd., Kanagawa, Japan

[21] Appl. No.: 52,284

[22] Filed: Apr. 26, 1993

Related U.S. Application Data

[63] Continuation of Ser. No. 685,770, Apr. 16, 1991, abandoned.

[30] Foreign Application Priority Data

Apr. 17, 1990 [JP] Japan ..... 2-101159

[51] Int. Cl.[5] ..... G03C 1/485

[52] U.S. Cl. ..... 430/598; 430/600; 430/607; 430/613; 430/615; 430/940

[58] Field of Search ..... 430/598, 600, 607, 613, 430/615, 940

[56] References Cited

U.S. PATENT DOCUMENTS 4,859,579 8/1989 Hirano et al. ..... 430/598

4,871,653 10/1989 Inoue et al. ..... 430/598

*Primary Examiner*—Thorl Chea

*Attorney, Agent, or Firm*—Sughrue, Mion, Zinn, Macpeak & Seas

[57] ABSTRACT

A silver halide photographic material which contains at least one compound represented by the following general formula (I) in at least one silver halide photographic emulsion layer or one hydrophilic colloid layer, whereby achieving high Dmax and low Dmin:

(I)

wherein T, U, V, and W each represents CH or N; $R^1$ represents a substituent group; $R^2$, $R^3$, $R^4$, $R^5$ and $R^6$each represents a hydrogen atom or a substituent group, provided that at least one among the substituents of $R^2$ to $R^6$ represents a group to be eliminated in the form of $R^m$—H (m=an integer from 2 to 6) under an alkaline condition; X represents a counter ion for adjusting the charge balance; n represents the number of counter ions necessary to adjust the charge balance; and further, any pair of adjacent groups among the substituents from $R^1$ to $R^6$ may combine with each other to form a ring.

13 Claims, No Drawings

SILVER HALIDE PHOTOGRAPHIC MATERIALS

This is a continuation of application Ser. No. 07/685,770 filed Apr. 16, 1991, now abandoned.

FIELD OF THE INVENTION

This invention relates to a silver halide photographic material and, more particularly, to a silver halide photographic material containing a novel nucleating agent.

BACKGROUND OF THE INVENTION

Nucleating agents have been used for many purposes in silver halide photographic materials. For instance, hydrazines which have been most prevailingly used as nucleating agent have been adopted as development nucleus forming agents in direct positive silver halide emulsions of the internal latent-image type. In negative silver halide emulsions which form a latent image at the surface thereof, they have been used to increase sensitivity and/or contrast.

Silver halide emulsions which have sensitive nuclei predominantly inside the silver halide grains and which generally form latent images inside the grains, are called silver halide emulsions of the internal latent-image type. They are distinguished from silver halide emulsions of the kind which form latent images on the surface of the grains to an appreciable extent.

A method of forming direct positive images by subjecting silver halide photographic emulsions of the internal latent-image type to surface development in the presence of a nucleating agent, and the photographic emulsions or photosensitive materials to which such a method is applicable are known, e.g., in U.S. Pat. Nos. 2,456,953, 2,497,875, 2,497,876, 2,588,982, 2,592,250, 2,675,318, 3,227,552 and 3,317,322, British Patents 1,011,062, 1,151,363, 1,269,640 and 2,011,391, JP-B-43-29405, JP-B-49-38164 (The term "JP-B" as used herein means an "examined Japanese patent publication"), JP-A-53-16623, JP-A-53-137133, JP-A-54-37732, JP-A-54-40629, JP-A-54-74536, JP-A-54-74729, JP-A-55-52055, JP-A-55-90940 (The term "JP-A" as used herein means an "unexamined published Japanese patent application"), and so on.

In the method described above for obtaining a direct positive image, it is more common to incorporate a nucleating agent in a photographic emulsion layer or another appropriate constituent layer of a photosensitive material than to add such an agent to a developer.

Hydrazine compounds are well-known as nucleating agents which can be incorporated in silver halide photosensitive materials.

In general, hydrazine nucleating agents can bring about a great difference between the maximum density (Dmax) and the minimum density (Dmin), so that they are superior in discrimination, However, they have the defect that they require high pH (i.e., pH>12) for processing.

Heterocyclic quaternary ammonium salts are known as the nucleating agents which can function in processing at a low pH ( pH≦12 ) . Examples of such salts are disclosed in U. S. Pat. Nos. 3,615,615, 3,719,494, 3,734,738, 3,759,901, 3,854,956, 4,094,683 and 4,306,016, British Patent 1,283,835, JP-A-52-3426, and JP-A-52-69613. In particular, propargyl- or butinyl-substituted heterocyclic quaternary ammonium salt compounds disclosed in U.S. Pat. No. 4,115,122 function as nucleating agents which are excellent in discrimination when incorporated in direct positive silver halide emulsions. Other alkynyl-substituted heterocyclic quaternary ammonium salt compounds similar in function to the above-cited examples are disclosed, e.g., in U.S. Pat. Nos. 4,471,044, 4,828,973 and 4,859,579, JP-A-62-210451, JP-A-63-121042, JP-A-01-191132, and U.S. Pat. No. 4,306,016.

In addition, dihydropyridine compounds are known as highly active nucleating agent with an aptitude for low pH processing. Examples thereof are disclosed, e.g., in U.S. Pat. No. 3,719,494, JP-A-62-291637, and British Patent 2,172,710B. However, those compounds do not exhibit satisfactory stability with the lapse of time.

On the other hand, quaternary ammonium salt type compounds are known to function as development accelerators in silver halide negative emulsion systems. Examples of such compounds are disclosed in U.S. Pat. No. 4,135,931, JP-A-52-114328, JP-A-52-121321, German Patent 2,647,940 and Belgian Patent 721,568.

SUMMARY OF THE INVENTION

Therefore, a first object of this invention is to provide a direct positive photosensitive material which can achieve satisfactory reversal efficiency (that is, a high Dmax and low Dmin).

A second object of this invention is to provide a direct positive photosensitive material in which a small amount of nucleating agent is incorporated to produce a desired nucleating effect without inhibiting spectral sensitization.

A third object of this invention is to provide a multilayer direct positive color photosensitive material which is uniform in image density and excellent in color balance, and moreover, shows satisfactory graininess even when processed with an exhausted running solution.

A fourth object of this invention is to provide a direct positive photosensitive material which causes little change in photographic properties, such as a decrease in Dmax and an increase in Dmin values, with the lapse of time under conditions of high temperature and/or high humidity.

A fifth object of this invention is to provide a direct positive photosensitive material which is hard to produce high-intensity negative images.

A sixth object of this invention is to provide a direct positive photosensitive material which ensures a rapid development at the initial stage thereof.

A seventh object of this invention is to provide a negative photosensitive material which has an increased photographic speed.

These and other objects are attained with a silver halide photographic material which contains at least one compound represented by the following general formula (I) in at least one light-sensitive silver halide photographic emulsion layer or a hydrophilic colloid layer adjacent thereto, preferably the compound is in an internal latent-image silver halide photographic emulsion layer in a material for forming positive images, while in a material for forming negative images, it is preferably in a surface latent-image silver halide photographic emulsion layer:

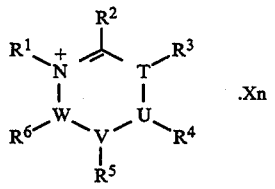

(I)

wherein T, U, V, and W each represents CH or N; $R^1$ represents a substituent group; $R^2$, $R^3$, $R^4$, $R^5$ and $R^6$ each represents a hydrogen atom or a substituent group, provided that at least one of $R^2$ to $R^6$ represents a group to be eliminated under an alkaline condition; X represents a counter ion for adjusting the charge balance; n represents the number of counter ions necessary to adjust the charge balance; and further, any pair of adjacent groups among the substituents from $R^1$ to $R^6$ may combine with each other to form a ring, and any of the substituents from $R^1$ to $R^6$ may contain a moiety capable of promoting adsorption to silver halide grains.

DETAILED DESCRIPTION OF THE INVENTION

A nitrogen-containing heterocyclic ring completed by T, U, V or W is one which contains 1 to 3 nitrogen atoms, with specific examples including tetrahydropyridinium, tetrahydropyridazinium, tetrahydropyrimidinium, tetrahydropyrazinium, tetrahydrotriazinium, and the like.

Substituent groups represented by $R^1$ to $R^6$ may be the same or different. Examples include alkyl groups (preferably containing 1 to 18 carbon atoms, such as methyl, ethyl, cyclohexyl, etc.), alkenyl groups (preferably containing 2 to 18 carbon atoms, such as vinyl, allyl, butenyl, etc.), alkynyl groups (preferably containing 2 to 18 carbon atoms, such as ethynyl, propargyl, butynyl, etc.), aralkyl groups (preferably containing 7 to 20 carbon atoms, such as benzyl, etc.), aromatic groups (preferably containing 6 to 20 carbon atoms, such as phenyl, naphthyl, etc.), a hydroxyl group, aliphatic oxy groups (including alkoxy groups, alkenyloxy groups and alkinyloxy groups, preferably containing 1 to 18 carbon atoms, such as methoxy, ethoxy, allyloxy, propargyloxy, butinyloxy, etc.), aromatic oxy groups (preferably containing 6 to 20 carbon atoms, such as phenoxy, etc.), halogen atoms (e.g., fluorine, chlorine, bromine, iodine, etc.), an amino group, substituted amino groups (preferably containing 1 to 18 carbon atoms, such as methylamino, dimethylamino, propargylamino, phenylamino, etc.), aliphatic thio groups (preferably containing 1 to 18 carbon atoms, such as methylthio, propargylthio, etc.), aromatic thio groups (preferably containing 6 to 20 carbon atoms, such as phenylthio, etc.), acyloxy groups (preferably containing 1 to 18 carbon atoms, such as acetoxy, benzoxy, etc.), sulfonyloxy groups (preferably containing 1 to 18 carbon atoms, such as methanesulfonyloxy, toluenesulfonyloxy, etc.), acylamino groups (preferably 1 to 18 carbon atoms, such as acetylamino, benzoylamino, etc.), sulfonylamino groups (preferably containing 1 to 18 carbon atoms, such as methylsulfonylamino, phenylsulfonylamino, etc.), carboxyl group, aliphatic oxycarbonyl groups (preferably containing 2 to 18 carbon atoms, such as methoxycarbonyl, propargyloxycarbonyl, etc.), aromatic oxycarbonyl groups (preferably containing 7 to 20 carbon atoms, such as phenoxycarbonyl, etc.), acyl groups (preferably containing 1 to 20 carbon atoms, such as formyl, acetyl, benzoyl, etc.), a carbamoyl group, N-substituted carbamoyl groups (preferably containing 2–20 carbon atoms, such as N-methylcarbamoyl, N-propargylcarbamoyl, N-phenylcarbamoyl, etc.), a sulfamoyl group, N-substituted sulfamoyl groups (preferably containing 1 to 18 carbon atoms, such as N-methyl-sulfamoyl, N,N-dimethylsulfamoyl, N-butinylsulfamoyl, N-phenylsulfamoyl, etc.), a sulfo group, a cyano group, a ureido group, substituted ureido groups (preferably containing 2 to 20 carbon atoms, such as 3-methylureido, 3-propargylureido, 3-phenylureido, etc.), substituted urethane groups (preferably containing 2 to 20 carbon atoms, such as methoxycarbonylamino, propargyloxycarbonylamino, pyhenoxycarbonylamino, etc.), carbonic acid ester groups (preferably containing 2 to 20 carbon atoms, such as ethoxycarbonyloxy, propargyloxycarbonyloxy, phenoxycarbonyloxy, etc.), and substituted or unsubstituted imino groups (preferably containing not more than 18 carbon atoms, such as N-methylimino, N-propargylimino, etc.).

The above-cited substitutent groups may further be substituted by one or more such groups.

As for the groups represented by $R^2$to $R^6$ which can be eliminated from the compounds of formula (I) under an alkaline condition, though some have already been cited above, a more detailed description thereof is given below. Examples of such groups include halogen atoms, and groups capable of binding to the nitrogen-containing 6-membered hetero ring via their respective oxygen, sulfur, nitrogen, phosphorus or carbon atoms. As the halogen atoms, those mentioned above as $R^1$ to $R^6$ substituents are examples. Examples of groups containing an oxygen atom at the binding site include not only the aliphatic and aromatic oxy, acyloxy, sulfonyloxy and carbonic acid ester groups already described, but also heterocyclyloxy groups (e.g., those containing not more than 20 carbon atoms, such as 2-pyridyloxy, tetrazolyloxy, triazolyloxy, 2-oxazolyloxy, 2-thiazolyloxy, etc.), sulfinyloxy groups (e.g., those containing not more than 20 carbon atoms, such as methylsulfinyloxy, phenylsulfinyloxy, etc.), carbamoyloxy groups (e.g., those containing not more than 20 carbon atoms, such as N-methylcarbamoyloxy, N-methyl-N-phenylcarbamoyloxy, etc.), aminoxy groups (e.g., those containing not less than 20 carbon atoms, such as N,N-diethylaminoxy, N-acetylaminoxy, etc.), and phosphonoxy groups (e.g., those containing not more than 20 carbon atoms, such as diethylphosphonoxy, diphenylphosphonoxy, etc.). Examples of groups containing a sulfur atom at the binding site include not only the aliphatic and aromatic thio groups already described, but also heterocyclylthio groups (e.g., those containing not more than 20 carbon atoms, such as 2-pyridylthio, tetrazolylthio, triazolylthio, 2-oxazolylthio, 2-thiazolylthio, 2-benzoxazolylthio, 2-benzothiazolylthio, etc.), sulfonyl groups (e.g., those containing not more than 20 carbon atoms, such as methylsulfonyl, octylsulfonyl, phenylsulfonyl, etc.), sulfinyl groups (e.g., those containing not more than 20 carbon atoms, such as methylsulfinyl, phenylsulfinyl, etc.), sulfonylthio groups (e.g., those containing not more than 20 carbon atoms, such as methylsulfonylthio, phenylsulfonylthio, etc.), acylthio groups (e.g., those containing not more than 20 carbon atoms, such as acetylthio, benzoylthio, etc.), carbamoylthio groups (e.g., those containing not more than 20 carbon atoms, such as N,N-diethylcarbamoylthio), sulfonium groups (e.g., those containing not more than 20 carbon atoms, such as dimethylsulfonium), and sulfo group. Examples of groups containing an nitrogen atom at the binding site include not only the acylamino and sulfonylamino groups already described, but also heterocyclylamino groups (e.g., those containing not more than 20 carbon atoms, such as tetrazolylamino, triazolylamino, 2-oxazolylamino, 2-thiazolylamino, 4-pyridylamino, etc.), sulfinylamino groups (e.g., those containing not more than 20 carbon atoms, such as methylsulfinylamino, phenylsulfinylamino, etc.), sulfamoylamino groups (e.g. those containing not more than 20 carbon atoms, such as dimethylsulfamoylamino, phenylsulfamoylamino, etc.), and ammonium groups (e.g., those containing not more than 20 carbon atoms, such as trimethylammonium, benzyldimethylammonium, etc.). Examples of groups containing a phosphorus atom at the binding site include phosphono groups (e.g., those containing not more than 20 carbon atoms, such as diphenylphosphono), and phosphonium groups (e.g., those containing not more than 20 carbon atoms, such as triethyl phosphonium, triphenyl phosphonium, etc.). Groups containing a carbon atom at the binding site are those which are stable as a carbon anion, with examples including a cyano group and —$CW^1W^2W^3$ (wherein $W^1$, $W^2$ and $W^3$ each represents a hydrogen atom or an electron attracting group, provided that at least one of them is an electron attracting group, with examples including a cyano group, a sulfonyl group, a $C_{1-20}$ acyl group, a $C_{2-20}$ alkoxycarbonyl group, a carbamoyl group and a halogen atom).

A ring completed by combining any pair of adjacent groups among $R^1$, $R^2$, $R^3$, $R^4$, $R^5$ and $R^6$ includes 3- to 12-membered aromatic or nonaromatic hydrocarbon or heterocyclic rings, preferably 5- to 7-membered rings, and more preferably 5- or 6-membered ring.

Examples of a ring completed by combining $R^1$ with $R^2$ include pyridinium, quinolinium, isoquinolinium, phenanthridinium, naphthoquinolinium, thiazolium, benzothiazolium, naphthothiazolium, oxazolium, benzoxazolium, naphthoxazolium, imidazolium, benzimidazolium, naphthoimidazolium, pyrrolium, triazolium, thiadiazolium, oxadiazolium, tetrazolium, quinaldinium, pyridazinium, pyrimidinium, triazinium, and hydrogen-added reductants of these cations.

The rings formed by combining $R^2$ with $R^3$, $R^3$ with $R^4$, $R^4$ with $R^5$, $R^5$ with $R^6$, and $R^6$ with $R^1$ are nonaromatic, with examples including cyclopentane, cyclopentene, cyclohexane, cyclohexene, indane, tetralin, pyrrolidine, pyrroline, piperidine, tetrahydrofuran, dihydrofuran, tet rahydropyran, dihydropyran, morpholine, piperazine, oxazoline, oxazolidine, thiazoline, thiazolidine, cycloheptane, cycloheptene, cyclobutane, butyrolactone, and pyrrolidone.

Examples of a group capable of accelerating adsorption to silver halide which can be contained in $R^1$ to $R^6$ include a thioamido group, a mercapto group and a 5- or 6-membered nitrogen-containing heterocyclyl group.

These adsorption accelerating groups, though they may be attached in any form to $R^1$ to $R^6$, preferably assume the form shown by the following general formula (II):

$$Y—(L)_m— \qquad (II)$$

(wherein Y represents the above-described group which can accelerate the adsorption to silver halide; L represents a linkage group; and m represents 0 or 1).

Among the adsorption accelerating groups represented by Y, thioamido groups are divalent ones represented by $$—\overset{\overset{\displaystyle S}{\|}}{C}—(\text{amino})—.$$

These groups are preferably non cyclic thioamido groups, though they may be a part of a cyclic structure. Adsorption accelerating groups of the thioamido type which can be adopted effectively in this invention are chosen from those disclosed in U.S. Pat. Nos. 4,030,925, 4,031,127, 4,080,207, 4,245,037, 4,255,511, 4,266,013 and 4,276,364, and *Research Disclosure* Vol. 151, Item 15162 (Nov. 1976), and ibid. Vol. 176, Item 17626 (Dec. 1978). Thioamido groups preferred in particular are those represented by the following general formula (III):

$$R^7—E—\overset{\overset{\displaystyle S}{\|}}{C}—E'— \qquad (III)$$

(wherein either E or E' represents —$N(R^8)$—, and the other represents —O—, —S—, or —$N(R^9)$—; $R^7$ represents a hydrogen atom, or a $C_{1-20}$ aliphatic or $C_{6-20}$ aromatic group, or it combines with E or E' to complete a 5- or 6-membered heterocyclic ring; and $R^8$ and $R^9$ each represents a hydrogen atom, or a $C_{1-20}$ aliphatic or $C_{6-20}$ aromatic group).

The thioamido groups represented by the formula (III) include groups derived from thiourea, thiourethane, dithiocarbaminic acid esters and so on. In addition, when E or E' combines with $R^7$ to form a ring, acidic nuclei which constitute conventional merocyanine dyes can be given as examples. Examples of such acidic nuclei include 4-thiazoline-2--thione, thiazolidine-2-thione, 4-oxazoline-2-thione, oxazolidine-2-thione, 2-pyrazoline-5-thione, 4-imidazoline-2-thione, 2-thiohydantoin, rhodanine, isorhodanine, 2-thio-2,4-oxazolidinedione, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione and benzothiazoline-2-thione. These nuclei each may be further substituted.

Examples of a mercapto type adsorption accelerating group, which is one of adsorption accelerating groups represented by Y, include aliphatic mercapto groups, aromatic mercapto groups, and heterocyclic mercapto groups (some of which have been already described as ring-forming thioamido groups, which correspond to tautomers when they contain a nitrogen atom at the position adjacent to the carbon atom to which the SH group is attached). Examples of an aliphatic mercapto group include mercaptoalkyl groups (such as mercaptoethyl, mercaptopropyl, etc.), mercaptoalkenyl groups (such as mercaptopropenyl, etc.), and mercaptoalkynyl groups (such as mercaptobutynyl, etc.). Examples of an aromatic mercapto group include a mercaptophenyl group and a mercaptonaphthyl group. The heterocyclic mercapto groups include a 4-mercaptopyridyl group, a 5-mercaptoquinolinyl group and a 6-mercaptobenzothiazolyl group in addition to those already mentioned as ring-forming thioamido groups.

Examples of a 5- or 6-membered nitrogen-containing hetero ring type adsorption accelerating agent, which is one of the adsorption accelerating agents represented by Y, include those constituted by nitrogen, oxygen, sulfur and/or carbon atoms. Suitable examples of such hetero rings include benzotriazole, triazole, tetrazole, indazole, benzimidazole, imidazole, benzothiazole, thiazole, benzoxazole, oxazole, thiadiazole, oxadiazole, triazine and like rings. Also, these rings each may have appropriate substituent group (s). The substituent groups include those substituent groups described for $R^1$ above. The more preferred nitrogen-containing hetero rings include benzotriazoles, triazoles, tetrazoles and indazoles, and the most preferred are benzotriazoles.

Examples of preferred nitrogen-containing hetero rings include benzotriazole-5-yl, 6-chlorobenzotriazole-5-yl, benzotriazole-5-carbonyl, 5-phenyl-l,3,4-triazole-2-yl, 4-(5-methyl-l,3,4-triazole--2-yl)--benzoyl, 1H-tetrazole-5-yl, 3-cyanoindazole-5-yl, 1,2,3,4thiatriazole-5-yl, and so on.

The linkage group represented by L in the general formula (II) is an atom or atoms comprising at least one C, N, S or N atom. Examples of L include alkylene groups, alkenylene groups, alkynylene groups, arylene groups, —O—, —S—, —NH—, —N=, —CO—, —$SO_2$—(which each may have a substituent group), and combinations of two or more thereof. In more detail, they are (1) alkylene groups (preferably containing 1 to 12 carbon atoms, such as methylene, ethylene, trimethylene, etc.), (2) alkenylene groups (preferably containing 2 to 12 carbon atoms, such as vinylene, butenylene, etc.), (3) alkynylene groups (preferably containing 2 to 12 carbon atoms, such as ethynylene, butynylene, etc.), (4) arylene groups (preferably containing 6 to 10 carbon atoms, such as phenylene, naphthylene, etc.), (5) —O—, (6) —S—, (7) —NH—, (8) —N=, (9) —CO—, (10) —$SO_2$—, and combinations of two or more thereof, with specific examples including

(11) $-O-\overset{O}{\overset{\|}{C}}-$, (12) $-NH-\overset{O}{\overset{\|}{C}}-$, (13) $-NHSO_2-$,

(14) $-O-\overset{O}{\overset{\|}{C}}NH-$, (15) $-NH\overset{O}{\overset{\|}{C}}NH-$,

(16) —$NHSO_2NH$—, and those formed by combining one among the groups from (1) to (4) with one among the groups from (5) to (16) (such as $-(\text{alkylene})-\overset{O}{\overset{\|}{C}}NH-$, $-(\text{arylene})-SO_2NH-$, $-(\text{arylene})-NH\overset{O}{\overset{\|}{C}}NH-$, and so on).

A counter ion X for adjusting the charge balance is an arbitrary anion selected to offset positive charge generated at the site of the quaternary ammonium salt in the heterocyclic ring. Examples of a monovalent anion include a bromide ion, a chloride ion, an iodide ion, a p-toluenesulfonate ion, an ethylsulfonate ion, a perchlorate ion, a trifluoromethanesulfonate ion, a thiocyanate ion, a picrate ion, $BF_4^-$, $PF_6^-$, and so on. In the case of such a monovalent anion, n is 1. As for the divalent anion, sulfate ion, oxalate ion, benzenedisulfonate ion and so on are examples. In this case, n is ½. When the heterocyclic quaternary ammonium salt further contains an anionic substituent, such as a sulfoalkyl group, the salt can assume the form of betaine. Such compounds do not require a counter ion, so n is 0. On the other hand, when the heterocyclic quaternary ammonium salt contains two anionic substituents such as two sulfoalkyl groups, X represents a cationic counter ion, examples of which include alkali metal ions (such as sodium ion, potassium ion, etc.), and ammonium ions (such as triethylammonium, etc.).

Among compounds represented by the foregoing general formula (I), those meeting the following conditions are preferred over others.

(i) T, U, V and W are all CH;

(ii) either $R^4$ or $R^5$ contains a group to be eliminated under an alkaline condition;

(iii) $R^1$ and $R^2$ combine with each other to complete a 5- to 7-membered nitrogen-containing heterocyclic ring; or (iv) at least one of the substituent groups from $R^1$ to $R^6$ contains a group capable of accelerating the adsorption to silver halide grains.

Examples of the compounds useful in this invention are illustrated below. However, the invention should not be construed as being limited to these examples.

(1)

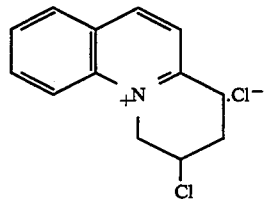

(2)

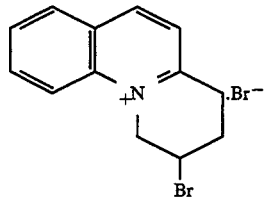

(3)

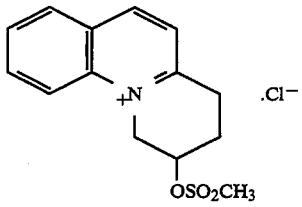

(4)

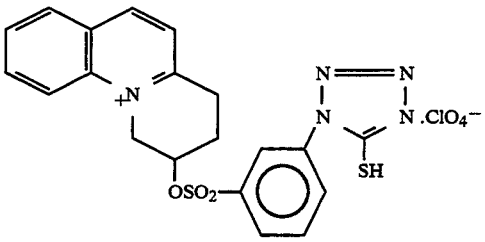

-continued
(5)
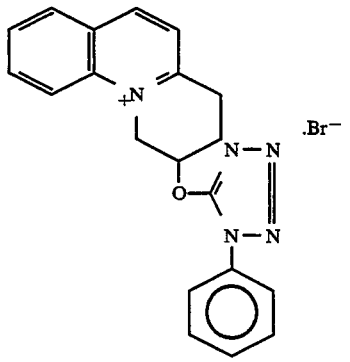
(6)
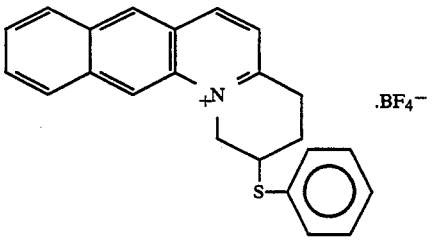
(7)
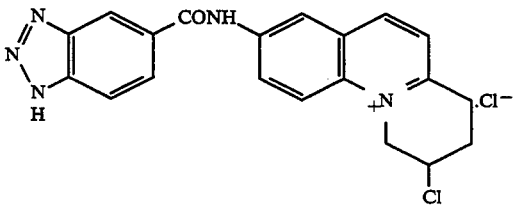
(8)
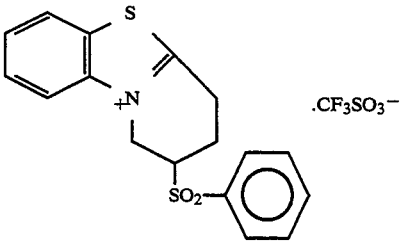
(9)
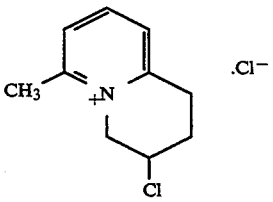
(10)
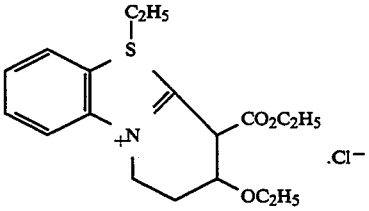
-continued
(11)
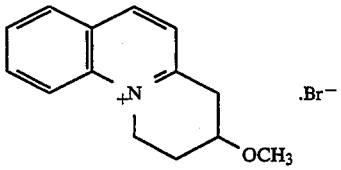
(12)
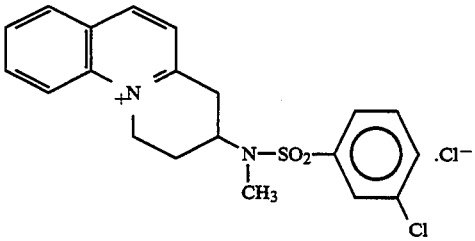
(13)
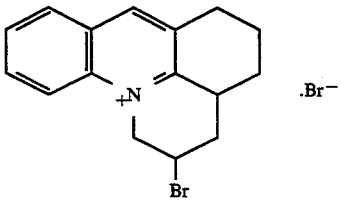
(14)
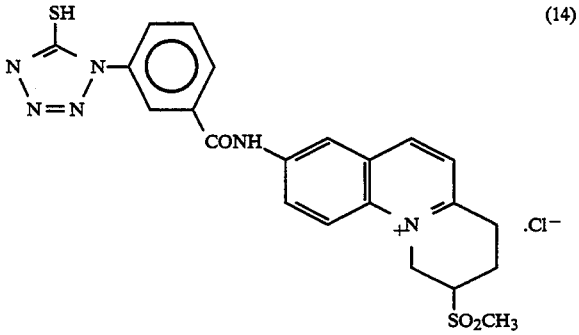
Examples of synthesis of the compounds of formula (I) of this invention are described below in detail using Compound (2) as a model. Other compounds can be synthesized in a similar manner. (1-1) Synthesis of Compound (2):
(H) Reaction Scheme
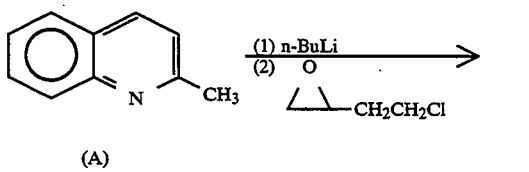
(A)
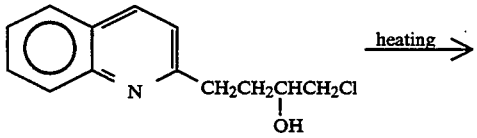
(B)

-continued (H) Reaction Scheme

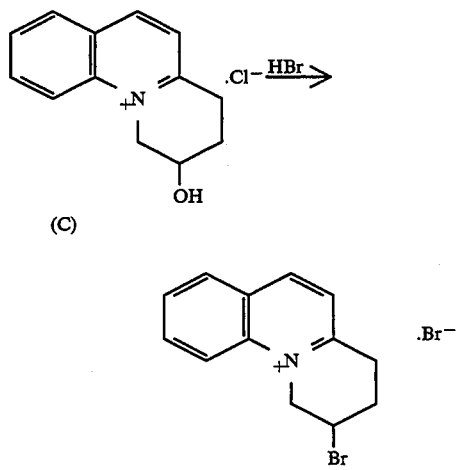

Compound (2)

(1-2) Synthesis of Compound (C)

To 30 ml of a tetrahydrofuran solution containing 4.3 g of quinaldine, 19.1 ml of a n-hexane solution of n-butyl lithium (1.57 mol/l) was added dropwise at −78° C. in an atmosphere of nitrogen. After the stirring was continued for 20 min., 2.8 g of 1-chloro-2,3-epoxypropane was added dropwise thereto as the temperature was kept at −40° C.

The reaction mixture was allowed to stand for 2 hours to complete the reaction, and then the temperature of the reaction system was raised to 10° C. Thereto, a water solution of ammonium chloride was added. The resulting mixture was extracted with 200 ml of ethyl acetate, and the ethyl acetate phase was separated and washed with water three times. The ethyl acetate solution was heated under reflux for 10 hours, and then the crystals deposited were filtered off to give 5.2 g of Compound (C) in a 73% yield.

(1-3) Synthesis of Compound (2)

2.4 g of Compound (C) was dissolved in 50 ml of a 30% acetic acid solution of hydrobromic acid, and stirred for 2 hours at 100° C. Excess acid was distilled away under reduced pressure, and the remaining crystals were harvested with ethyl acetate, and filtered off to give 3.2 g of the desired product (Compound (2)) in a 93% yield.

Incorporation of the compounds represented by the general formula (I) into a photographic light-sensitive material can be achieved by adding them to a hydrophilic colloid solution in such a condition that they are dissolved in an organic solvent miscible with water, such as alcohols (e.g., methanol, ethanol), esters (e.g., ethyl acetate), ketones (e.g., acetone), etc., or in the form of aqueous solution when they are soluble in water.

When they are added to a photographic emulsion, that addition may be carried out at any time so long as it occurs during the period from the start of chemical ripening to just before coating. However, the addition after the conclusion of chemical ripening is preferred.

It is desirable in this invention that the nucleating agent represented by the general formula (I) be incorporated in a silver halide emulsion layer, though it may be contained in a hydrophilic colloid layer adjacent to a silver halide emulsion layer.

A suitable amount of the nucleating agent to be added can be varied over a wide range, the specific amount depending on the characteristics of silver halide emulsions to be associated therewith, their chemical structure and the developing conditions used. In practice, however, amounts ranging from about $1\times10^{-8}$ to about $1\times10^{-2}$ mole per mole of silver in a silver halide emulsion layer are appropriate, and those ranging from about $1\times10^{-7}$ to about $1\times10^{-3}$ mole per mole of silver, are preferred.

In photographic emulsion layers of the photographic light-sensitive material of this invention, any silver halides, including silver bromide, silver iodobromide, silver iodochlorobromide, silver chlorobromide and silver chloride, may be used.

Silver halide grains in the photographic emulsions may be so-called regular grains having a regular crystal form, such as that of a cube, an octahedron, a tetradecahedron, etc., or those having an irregular crystal form, such as that of a sphere, etc., those having crystal imperfections, such as twinned plane, or those having a composite of two or more of the above-cited forms. A mixture of various crystal forms of silver halide grains may be used.

The silver halide grains may be fine grains having a size of about 0.1 micron or less, or coarse ones having a projected-area corresponding diameter up to about 10 microns. As for the distribution of sizes among grains, both a monodispersed emulsion having a narrow distribution and a polydispersed one having a broad distribution maybe employed. From the standpoint of gradation adjustment and image-quality control, however, monodispersed emulsions are preferable.

The silver halide photographic emulsions to be used in this invention can be prepared using known methods described, e.g., in *Research Disclosure*, vol. 176, No. 17643, pp- 22–23, entitled "1. Emulsion Preparation and Types", (Dec. 1978); and *Supra*, vol. 187, No. 18716, p. 648 (Nov. 1979).

In addition, photographic emulsions appropriate in this invention can be prepared using the methods described, e.g., in P. Glafkides, *Chimie et Physique Photographique*, Paul Montel, Paris (1967), G.F. Duffin, *Photographic Emulsion Chemistry*, The Focal Press, London (1966), V.L. Zelikman et al, *Making and Coating Photographic Emulsion*, The Focal Press, London (1964), and so on. Specifically, any process including an acid process, a neutral process and an ammonia process, may be employed.

Suitable methods for reacting a water-soluble silver salt with a water-soluble halide include, e.g., a single jet method, a double jet method, or a combination thereof. Also, a method in which silver halide grains are produced in the presence of excess silver ion (the so-called reverse mixing method) can be employed. On the other hand, the so-called controlled double jet method, in which the pAg of the liquid phase in which silver halide grains are to be precipitated is maintained constant, may be also employed. According to this method, a silver halide emulsion having a regular crystal form and an almost uniform distribution of grain sizes can be obtained.

Further, silver halide grains can be ripen physically in the presence of known silver halide solvents (e.g., ammonia, potassium thiocyanate, and the thioether and the thione compounds as disclosed in U.S. Pat. No.

3,271,157, JP-A-51-12360, JP-A-53-82408, JP-A-53-144319, JP-A-54-100717, JP-A-54-155828, and so on). According to this process also, silver halide emulsions which are regular in crystal form and nearly uniform in grain size distribution can be obtained.

Silver halide emulsions comprising regular grains as described above can be obtained by controlling the pAg and pH in the course of grain formation. Details thereof are described, e.g., in *Photographic Science and Engineering*, vol. 6, pp. 159–165 (1962), *Journal of Photographic Science*, vol. 12, pp. 242–251 (1964), U.S. Pat. No. 3,655,394, and British Patent 1,413,748.

Monodispersed emulsions which can be preferably used are represented by emulsions in which silver halide grains having an average grain diameter greater than about 0.05 micron are present and, moreover, at least 95 wt % of the grains have their individual sizes within the range of ±40% of the average grain diameter. In particular, emulsions in which silver halide grains having an average grain diameter ranging from 0.15 to 2 microns are present and, moreover, at least 95%, based on the weight or number of the grains, of the grains have individual sizes within the range of ±20% of the average grain diameter, are preferred. Such emulsions can be prepared using the methods disclosed in U.S. Pat. Nos. 3,574,628 and 3,655,394, and British Patent 1,413,748. In addition, monodispersed emulsions as disclosed, e.g., in JP-A-48-8600, JP-A-51-39027, JP-A-51-83097, JP-A-53-137133, JP-A-54-48521, JP-A-54-99419, JP-A-58-37635 and JP-A-58-49938 can be used to advantage.

Also, tabular grains with an aspect ratio of at least 5 can be used in this invention. Such tabular grains can be prepared with ease in accordance with methods described, e.g., in Gutoff, *Photographic Science and Engineering*, Vol. 14, pp. 248–257 (1970), U.S. Pat. Nos. 4,434,226, 4,414,310, 4,433,048 and 4,439,520, British Patent 2,112,157, and so on. The use of tabular grains has an advantage in that the covering power is heightened, the efficiency of color sensitization by sensitizing dyes is raised, and so on. Such effects are described in detail in U.S. Pat. No. 4,435,226 cited above.

On the other hand, grains having a crystal form controlled by the use of sensitizing dyes or certain additives in the course of grain formation may be used.

The crystal structure of the grains may be uniform throughout, or the interior and the surface of the grains may differ in halide composition, or the grains may assume a layer structure. These emulsion grains are disclosed, e.g., in British Patent 1,027,146, U.S. Pat. Nos. 3,505,068 and 4,444,877, JP-A-60-143331, and so on. Further, silver halide grains in which crystal surfaces differing in halide composition are joined together through epitaxial junction, or emulsion grains in which silver halide grains are joined together with a salt other than a silver halide, such as silver thiocyanate, lead oxide or the like may be used. These emulsion grains are disclosed in U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067, JP-A-59-162540, and so on.

Furthermore, emulsion grains having a so-called internal latent-image structure, which are prepared by chemically ripening crystal surfaces to form sensitivity nuclei consisting of $Ag_2S$, Agn, Au or so on, and then by allowing silver halide to further grow around the nuclei, can be used.

In a process for producing silver halide grains or allowing the produced silver halide grains to ripen physically, cadmium salts, zinc salts, lead salts, thallium salts, iridium salts and their complex salts, rhodium salts and their complex salts, iron salts and their complex salts, and so on may be present.

It is desirable for production of direct positive color photosensitive materials in this invention that internal latent-image type unprefogged emulsions be used, and that a nucleating agent be used before or during the processing thereof.

Internal latent-image type unprefogged silver halide emulsions used in this invention are emulsions comprising silver halide grains the surfaces of which are not fogged in advance and in which latent images are formed predominantly inside the grains. More specifically, such emulsions are defined by the following method. A silver halide emulsion to be examined is coated on a transparent support in a prescribed thickness, exposed to light for a fixed time ranging from 0.01 to 10 sec., developed under two different conditions, and examined for maximum densities using a common method for measuring photographic densities. When the maximum density obtained by the development using the following developer A (internal developer) at 20° C. for 6 min. is at least 5 times, preferably 10 times, that obtained by the development using the following developer B (surface developer) at 18° C. for 5 min., the emulsion examined is regarded as an internal latent-image type unprefogged silver halide emulsion. Surface Developer B:

| | |
|---|---|
| Surface Developer B: | |
| Metol | 2.5 g |
| l-Ascorbic acid | 10 g |
| $NaBO_2.4H_2O$ | 35 g |
| KBr | 1 g |
| Water to make | 1 l |
| Internal Developer A: | |
| Metol | 2 g |
| Sodium sulfite (anhydrous) | 90 g |
| Hydroquinone | 8 g |
| Sodium carbonate (monohydrate) | 52.5 g |
| KBr | 5 g |
| KI | 0.5 g |
| Water to make | 1 l |

Examples of internal latent-image type emulsions include conversion type silver halide emulsions disclosed, e. g. , in British Patent 1,011,062, U.S. Pat. Nos. 2,592,250 and 2,456,943, and core/shell type silver halide emulsions. Examples of core/shell type silver halide emulsions include those disclosed, e.g., in JP-A-47-32813, JP-A-47-32814, JP-A-52-134721, JP -A-52-156614, JP-A-53-60222, JP-A-53-66218, JP-A-53-66727, JP-A-55-127549, JP-A-57-136641, JP-A-58-70221, JP--A--59-208540, JP-A-59-216136, JP-A-60-107641, JP-A-60-247237, JP-A-61-2148, JP-A-61-3137, JP-B-56-18939, JP-B-58-1412, JP-B-58-1415, JP-B-58-6935, JP-B-58-108528, JP-A-62-194248, U.S. Pat. Nos. 3,206,313, 3,317,322, 3,761,266, 3,761,276, 3,850,637, 3,923,513, 4,035,185, 4,395,478 and 4,504,570, European Patent 0017148, *Research Disclosure*, 16345 (Nov. 1977), and so on.

Removal of soluble silver salts from the emulsions before or after physical ripening can be effected using the noodle washing method, the flocculation method, or the ultrafiltration method.

In general, the emulsions used in this invention are physically and chemically ripened, and then spectrally sensitized. Additives used in these steps are described in detail in *Research Disclosure*, No. 43 (Dec. 1978) and *Supra*, No. 18716 (Nov. 1979), and the pages on which they are described, respectively, are noted in the following table.

In addition, other known photographic additives appropriate for in this invention are described in the above-cited literatures, and set forth together in the following table.

| Kind of Additive | RD 17643 | RD 18716 |
|---|---|---|
| 1. Chemical Sensitizer | p. 23 | p. 648, right column |
| 2. Sensitivity Increasing Agent | | p. 648, right column |
| 3. Spectral Sensitizer | pp. 23–24 | p. 648, right column, to p. 649, right column |
| 4. Brightening Agent | p. 24 | |
| 5. Antifoggant and Stabilizer | pp. 24–25 | p. 649, right column |
| 6. Light Absorbent, Filter Dye, and Ultraviolet Absorbent | pp. 25–26 | p. 649, right column, and p. 650, left column |
| 7. Stain Inhibitor | p. 25, right column | p. 650, from left to right column |
| 8. Dye Image Stabilizer | p. 25 | |
| 9. Hardening Agent | p. 26 | p. 651, left column |
| 10. Binder | p. 26 | p. 651, left column |
| 11. Plasticizer and Lubricant | p. 27 | p. 650, right column |
| 12. Coating Aid and Surface Active Agent | pp. 26–27 | p. 650, right column |
| 13. Antistatic Agent | p. 27 | p. 650, right column |

Various color couplers can be used in this invention. The color couplers are compounds of the kind which produce or release a substantially nondiffusible dye by a coupling reaction with the oxidation product of an aromatic primary amine color developing agent. Moreover, it is desirable that they themselves be substantially nondiffusible. Typical examples of useful color couplers include naphthol or phenol compounds, pyrazolone or pyrazoloazole compounds, and open-chain or heterocyclic ketomethylene compounds. Specific examples of such cyan, magenta and yellow couplers which can be used in this invention are described in *Research Disclosure*, No. 17643, p. 25, Item VII-D (Dec. 1978), *Supra*, No. 18717 (Nov. 1979), JP-A-62-215272, and the patent specifications quoted in these references.

Typical examples of the yellow couplers which can be used in this invention include two-equivalent yellow couplers having a splitting-off group of the type which is attached to the coupling active site via its oxygen or nitrogen atom. In particular, α-pivaloylacetanilide type couplers are excellent in fastness of the colored dyes, especially in the light fastness thereof, and α-benzoylacetanilide type couplers have the advantage that they can form dyes of high color density.

Among the 5-pyrazolone type magenta couplers, those substituted by an arylamino or acylamino group at the 3-position (preferably two-equivalent ones of the type which are attached to the coupling active site via their sulfur atom) can be used to advantage in this invention.

More favorable magenta couplers are pyrazoloazole couplers. Among them, the pyrazolo[5,1-c][1,2,4]-triazoles disclosed in U.S. Pat. No. 3,725,067 are preferred in particular. In addition, the imidazo[1,2-b]pyrazoles disclosed in U.S. Pat. No. 4,500,630 are highly favored because they can produce colored dyes showing small side absorption in the yellow region and having high fastness to light. Those couplers superior in these respects are the pyrazolo [1.5-b][1,2,4]triazoles disclosed in U.S. Pat. No. 4,540,654.

Cyan couplers which can be preferably used in this invention include naphthol and phenol type couplers as disclosed, e.g., in U.S. Pat. No. 2,474,293 and No. 4,052,212, and the phenol type couplers disclosed in U.S. Pat. No. 3,772,002, which have an alkyl group higher than the ethyl group at the m-position of the phenol nucleus. In addition, the 2,5-diacylamino substituted phenol type couplers are favored because of the fastness of the produced color images.

Colored couplers for compensating for unnecessary absorptions which the produced dyes have in the short wavelength region, couplers which form colored dyes with moderate diffusibility, colorless couplers, DIR couplers which can release a development inhibitor in proportion to the progress of the coupling reaction, and polymerized couplers, can also be used.

The standard amount of color couplers used is within the range of 0.001 to 1 mole per mole of light-sensitive silver halide. As for the yellow couplers, it is desirable to use them in an amount of 0.01 to 0.5 mole. As for the magenta couplers, it is desirable to use them in an amount of 0.03 to 0.3 mole. As for the cyan couplers, it is desirable to use them in an amount of 0.002 to 0.3 mole.

For the purpose of enhancement of color formability of couplers, a color formation intensifier can be used. Typical examples thereof include those described in JP-A-62-215272, pp. 121–125.

The above-described couplers are dissolved into a high boiling and/or a low boiling organic solvent, dispersed into a water solution of gelatin or another hydrophilic colloid in an emulsified condition (by high-speed stirring with a homogenizer or the like, or by application of mechanical force for fine grinding, for instance, using a colloid mill, or with the aid of a technique utilizing ultrasonic waves), and then added to an emulsion. Therein, although high boiling organic solvents are not necessarily used, the compounds described on JP-A-62-215272, pp. 137–144 can be preferably used.

Couplers of this invention can be dispersed into a hydrophilic colloid using methods described on JP-A-62-215272, pp. 144–146.

It is desirable in this invention that the photographic material contain one or more compounds which enable the fixation of formaldehyde gas through a reaction therewith (which is called a formalin scavenger, hereinafter).

Formalin scavengers which can be used in this invention include compounds which are represented by the following general formula (SI) or (SII), and moreover more, have an active hydrogen unit equivalent molecular weight, which is defined by the following formula, of 300 or below.

$$\text{Equivalent Molecular Weight} = \frac{\text{Molecular Weight}}{\text{Number of Active Hydrogen in Molecule}}$$

General Formula (SI):

-continued

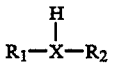

General Formula (SII):

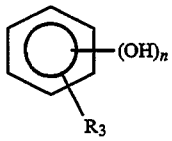

Therein, $R_1$ and $R_2$ each represents a hydrogen atom, an unsubstituted or substituted alkyl group, an unsubstituted or substituted aryl group, an acyl group, an alkoxycarbonyl group, a carbamoyl group or an amino group; or they may combine with each other to form a ring, provided that at least one of them represents an acyl group, an alkoxycarbonyl group, a carbamoyl group or an amino group; X represents CH or N; $R_3$ represents a hydrogen atom, an unsubstituted or substituted alkyl group or an unsubstituted or substituted aryl group, or it may form a bicyclic compound together with the phenyl group; and n represents an integer of 2 or above.

Two or more such formalin scavengers can be used as a mixture in this invention.

The formalin scavengers of this invention are incorporated into at least one constituent layer of the silver halide photographic material, including silver halide emulsion layers, subbing layers, protective layers, interlayers, filter layers, antihalation layers and other auxiliary layers. In other words, the purpose of formalin scavengers can be achieved by incorporating them in any layer, more specifically not only by incorporation in a polymeric magenta coupler-containing silver halide emulsion layer which causes deterioration of photographic properties by the contact with formaldehyde gas, but also by incorporation in layers arranged farther from or nearer to the support than said emulsion layer.

The incorporation of formalin scavengers appropriate for this invention into those layers can be effected by adding them, as they are, to coating compositions for forming such layers, or in a condition that they are dissolved in an appropriate solvent having no adverse influence onsilver halide color photographic materials, such as water, alcohol, etc., in a proper concentration. Also, these formalin scavengers can be added to coating compositions in such a condition that they are dissolved in advance into a high boiling and/or a low boiling organic solvent, and then emulsified and dispersed in an aqueous solution. The addition of the formalin scavengers may be carried out at any stage in the course of production, preferably just before the coating operation. A suitable addition amount thereof ranges from 0.01 to 10 g, preferably from 0.05 to 5 g, per $m^2$ of the silver halide color photographic material.

When the photographic material of this invention is used as a color photographic material, various kinds of discoloration inhibitors can be applied thereto. Typical examples of discoloration inhibitors which can be used in this invention include hydroquinones, 6-hydroxychromans, 5-hydroxycoumarans, spirochromans, p-alkoxyphenols, hindered phenols represented by bisphenols, gallic acid derivatives, methylenedioxybenzenes, aminophenols, hindered amines, and ether or ester derivatives obtained by silylating or alkylating the phenolic OH groups contained in each of the above-cited compounds. In addition, metal complexes represented by (bissalicylaldoxmato)nickel complex and (bis-N,N--di-alkyldithiocarbamoto)nickel complexes can be also used for the above-described purpose.

Compounds having both hindered amine and hindered phenol moieties in one molecule, as disclosed in U.S. Pat. No. 4,268,593, can produce desirable effects by preventing deterioration of yellow dye images upon exposure to heat, moisture and light. As for the preventing deterioration of magenta dye images, particularly upon exposure to light, the spiroindanes disclosed in JP-A-56-159644 and the chromans substituted by hydroquinone di- or monoether disclosed in JP-A-55-09835 can achieve good results. These compounds can accomplish their purpose when used in a proportion of, in general, from 5 to 100 wt % to their corresponding couplers, and emulsified together therewith, followed by incorporation into light-sensitive layers. In order to prevent cyan dye images from deteriorating by exposure to heat, and light in particular, it is more effective to introduce an ultraviolet absorbent into the cyan color-forming layer and its adjacent layer on each side. Moreover, an ultraviolet absorbent can be introduced into a hydrophilic colloid layer such as a protective layer.

The photographic material of this invention can contain dyes for preventing irradiation and halation, antistatic agents, slippability improving agents, and so on.

Typical examples of these additives are described in *Research Disclosure*, No. 17643 (Dec. 1970) and No. 18716 (Nov. 1979).

This invention can also be applied to a multilayer multicolor photographic material having at least two different spectral sensitivities over a support.

An multilayer multicolor photographic material comprises a support having thereon at least one red-sensitive emulsion layer, at least one green-sensitive emulsion layer and at least one blue-sensitive emulsion layer. These layers can be arranged in any order, if desired. Preferable coating orders include a) support—red-sensitive layer—green-sensitive layer—blue-sensitive layer, b) support—blue-sensitive layer—green-sensitive layer—red-sensitive layer, c) support —blue-sensitive layer—red-sensitive layer—green-sensitive layer, and d) support—green-sensitive layer —red-sensitive layer—blue-sensitive layer. Further, each of the above-described emulsion layers may comprise two or more of constituent layers differing in photographic speed, and two or more emulsion layers having the same color sensitivity may be sandwiched with light-insensitive layers. In general, cyan forming couplers are incorporated in a red-sensitive emulsion layer, magenta forming couplers in a green-sensitive emulsion layer, and yellow forming couplers in a blue-sensitive emulsion layer.

In addition to silver halide emulsion layers, it is desirable that the photographic materials relating to this invention be provided with proper auxiliary layers, such as a protective layer, an interlayer, a filter layer, a antihalation layer, a white reflecting layer, etc.

When internal latent-image type unprefogged emulsions are used in the photographic materials of this invention, such photographic materials are exposed imagewise, developed with a surface developer containing a p-phenylenediamine type color developing agent after or as they receive a fogging treatment with a nucleating agent, bleached and then fixed to produce direct-positive color images.

The photographic materials of this invention have the advantage that they can produce direct-positive color images of good quality even when developed with a low pH color developer (adjusted to pH 11.5 or lower).

Examples of nucleation accelerators which can be used for promoting the action of the nucleating agents of this invention include tetra-, tri- and pentaazaindenes which each contains at least one mercapto group optionally substituted by an alkali metal atom or an ammonio group, and compounds disclosed in JP-A-63-106656 (pp. 5–16).

Specific examples of such nucleation accelerators are given below. However, nucleation accelerators appropriate for this invention should not be construed as being limited to these compounds:

(A-1) 3-Mercapto-1,2,4-triazolo[4,5-a]pyridine,
(A-2) 3-Mercapto-1,2,4-triazolo[4,5-a]pyrimidine,
(A-3) 3-Mercapto-7-methyl-1,2,4-triazolo[4,5-a]-pyrimidine,
(A-4) 2-Mercapto-5-methylthio-1,3,4-thiadiazole,
(A-5) 3-Mercapto-4-methyl-1,2,4-triazole,
(A-6) 2-(3-Dimethylaminopropylthio)-5-mercapto-1,3,4-thiadiazole hydrochloride,
(A-7) Sodium salt of 2-mercapto-5-methylthiomethylthio-1,3,4-thiadiazole,
(A-8) 4-(2-Morpholinoethyl)-3-mercapto-l,2,4-triazole,
(A-9) 2-[2-(2-dimethylaminoethylthio)ethylthio]-5-mercapto-1,3,4-thiadiazole hydrochloride,
(A-10) 2-(6-Dimethylaminohexylthio)-5-mercapto-1,3,4-thiadiazole hydrochloride.

It is desirable that such a nucleation accelerator be incorporated in the photographic material, especially in internal latent-image type silver halide emulsions and other hydrophilic colloid layers ( such as an interlayer, a protective layer, etc.) , although it possible to incorporate it in a processing solution, as well as in the photographic material. Layers particularly desirable for the incorporation of such accelerators are the silver halide emulsion layers or layers adjacent thereto.

The nucleation accelerator is preferably incorporated in an amount ranging from $10^{-6}$ to $10^{-2}$ mole, particularly from $10^{-5}$ to $10^{-2}$ mole, per mole of silver halide.

When the nucleation accelerator is added to a processing solution, namely a developer or a prebath thereof, the addition amount thereof is preferably within the range of $10^{-8}$ to $10^{-3}$ mole, particularly $10^{-7}$ to $10^{-4}$ mole, per liter of the processing solution.

Also, two or more of the above-cited nucleation accelerators can be used in combination.

In the photographic materials of this invention, photographic emulsion layers and other layers are coated on a conventional flexible support, such as a plastic film, paper, cloth, etc., or a rigid support such as glass, earthenware, metal, etc. Materials useful as flexible support include films of semisynthetic or synthetic macromolecules, such as cellulose nitrate, cellulose acetate, cellulose acetate butyrate, polystyrene, polyvinyl chloride, polyethylene terephthalate, polycarbonate, etc., paper coated or laminated with a baryta layer or an $\alpha$-olefin polymer (e.g., polyethylene, polypropylene, ethylene/-butene copolymer), and so on. Such supports may be colored with a dye or a pigment.

For the coating to form silver halide emulsion layers and other hydrophilic colloid layers, various known methods such as a dip coating method, a roller coating method, a curtain coating method, an extrusion coating method and so on can be adopted. Also, two or more of layers may be coated simultaneously using the methods disclosed in U.S. Pat. Nos. 2,681,294, 2,762,791, 3,526,528 and 3,508,947, and so on, if desired.

When the photographic materials of this invention are used in a color diffusion transfer process, dye developing agents can be used as the coloring material. Those dyes which can be advantageously used as the coloring material are compounds of the kind which themselves are alkaline (in a developer) and nondiffusible (immobile), and which release a diffusible dye (or a precursor thereof) as a result of development. These diffusible dye-releasing coloring materials (DRR compounds) include diffusible dye-releasing couplers and redox compounds, and are useful as coloring materials for not only color diffusion transfer processes (wet processable type) but also heat developable photosensitive materials (dry processable type).

When the photographic materials of this invention are used in a color diffusion transfer process, the photographic emulsions may be coated on the same support as an image-receiving layer to form an integral unit, or on a support which is different from the support having thereon the image-receiving layer. The silver halide photographic emulsion layers (a light-sensitive element) and the image-receiving layer (an image-receiving element) may be provided in such a form that they are combined as a film unit, or provided separately as independent photographic materials. The integral unit form may be retained throughout the whole photographic processes, including exposure, development and appreciation of the formed photographic image, or the unit may be peeled apart after development. The latter structure is more effective for this invention than the former.

This invention can be applied to various kinds of photographic light-sensitive materials.

Typical examples of such photographic light-sensitive materials include color reversal films for slide or television, color reversal paper, and instant color films. In addition, the invention can be used in a full-color copying machine, color hard copies for preserving CRT images, and the like. Moreover, this invention can be applied to black-and-white photographic materials which utilize a mixture of three color-forming couplers.

A color developing solution to be used for the development-processing of the light-sensitive material of this invention is preferably an alkaline aqueous solution containing as a main component an aromatic primary amine type color developing agent. The preferred color developing agents are p-phenylenediamine compounds, though aminophenol compounds are also useful. Typical representatives of p-phenylenediamine compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfates, hydrochlorides or p-toluenesulfonates of the above-cited anilines. These compounds can also be used as a mixture of two or more thereof, if desired.

In general, the color developing solution contains pH buffering agents such as carbonates, borates or phosphates of alkali metals, and development inhibitors or antifoggants such as bromides, iodides, benzimidazoles, benzothiazoles or mercapto compounds. In addition, the solution can optionally contain various kinds of preservatives , e. g., hydroxylamine, diethylhydroxylamine, sulfites, hydrazines, phenylsemicarbazides, triethanolamine, catechol sulfonic acids , triethylenediamine ( 1, 4-diazabicyclo[2,2,2]octane), and so on; organic solvents such as ethylene glycol, diethylene glycol, etc.; development accelerators such as benzyl alcohol, polyethylene glycol, quaternary ammonium salts, amines, etc.; dye forming couplers; competing couplers; fogging agents such as sodium boron hydride, etc.; auxiliary developing agents such as 1-phenyl-3-pyrazolidone, etc.; viscosity imparting agents; and various chelating agents represented by aminopolycarboxylic acid, aminopolyphosphonic acid, alkylphosphonic acid and phosphonocarboxylic acid, e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediarnine-di (o-hydroxy-phenylacetic acid), and salts of the above-cited acids.

The pH of the color developing solution ranges generally from 9 to 12 ,and preferably from 9.5 to 11.5. The amount of the developing solution to be replenished, though it depends on the kind of color photographic light-sensitive materials to be processed, is generally 1 l or less per $m^2$ of the light-sensitive material processed. Also, it is feasible to reduce an amount of the replenisher to 300 ml or less by lowering the bromide ion concentration in the replenisher. When a replenisher is used in a reduced amount, it is desirable that evaporation and aerial oxidation of the developing solution be prevented by reducing the contact area between air and the developing solution in the processing tank. Also, the amount of the replenisher to be used can be reduced by adopting measures to inhibit the accumulation of bromide ion in the developing solution.

Photographic emulsion layers are generally subjected to a bleach-processing after color development. The bleach-processing may be carried out simultaneously with a fixation-processing (blix-processing), or separately therefrom. In order to further increase a processing speed, a blix-processing may be carried out after the bleach-processing. Also, the processing may be carried out with two consecutive bleach-fix baths, the fixation-processing may be carried out before a blix processing, or the bleach-processing may be carried out after a blix-processing. That is, any manner may be employed depending on the purpose. Examples of the bleaching agent which can be used include compounds of polyvalent metals, such as Fe(III), Co(III), Cr(IV), Cu(II), peroxides, quinones, nitro compounds etc. Representatives of such compounds are ferricyanides; dichromates; Fe(III) or Co(III) complex salts of organic acids, for example, aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycoletherdiaminetetraacetic acid, etc., citric acid, tartaric acid, malic acid, and so on; persulfates; hydrobromides; permanganates; nitrobenzenes; and so on.

In a bleaching bath, a bleach-fix bath and/or a prebath thereof, a bleach accelerator can be used, if needed.

After the desilvering processing, the silver halide color photographic material is, in general, subjected to a washing and/or stabilization processing. The volume of washing water required in the washing processing can be set variously depending on the characteristics of light-sensitive materials to be processed (e.g., on what kinds of couplers are incorporated therein), end-use purposes of light-sensitive materials to be processed, the temperature of washing water, the number of washing tanks (the number of stages), the way of replenishing washing water (e.g., whether a current of water flows in the counter direction, or not), and other various conditions. Of these conditions, the relation between the number of washing tanks and the volume of washing water in the multistage counter current process can be determined according to the methods described in *Journal of the Society of Motion Picture and Television Engineers*, volume 64, pages 248–253 (May 1955).

A suitable pH of the washing water in the processing of the photosensitive material of this invention ranges from 4 to 9, more preferably from 5 to 8. The washing temperature and time can be chosen variously depending on the characteristics and the intended use of the photosensitive materials to be processed. They are within the range of 20 seconds to 10 minutes at temperatures from 15° C. to 45° C., preferably 30 seconds to 5 minutes at temperatures from 25° C. to 40° C.

Also, the photosensitive material of this invention can be processed directly with a stabilizer instead of undergoing the above-described washing processing. To such a stabilization processing, all of known methods as disclosed in JP-A-57-8543, JP-A-58-14834 and JP-A-60-220345 can be applied.

To this stabilizing bath can be added various kinds of chelating agents and antimolds. Moreover, a solution which overflows the washing bath and/or the stabilizing bath in proportion to replenishment can be re-used in another processing step, such as a desilvering step.

Various kinds of processing solutions in this invention are used in the temperature range of 10°–50° C. Though a standard temperature is generally within the range of 33° C. to 38° C., temperatures higher than this range can be chosen to reduce the processing time through acceleration of the processing. Or lower temperatures than the foregoing range can be chosen to improve image quality and to enhance the stability of the pro-cessing bath.

It is desired that a processing bath used in each processing step be replenished at the minimum amount. A desirable replenishing amount ranges from 0.1 to 50 times, preferably from 3 to 30 times, the quantity of the processing solution brought thereinto from the prebath thereof per unit area of the light-sensitive material.

When the photographic material of this invention comprises internal latent-image type emulsions, it produces a direct-positive image through development with a surface developer. The surface developer refers to developer which acts substantially on a latent image or fogged nuclei present at the surfaces of silver halide grains to induce a developmental process. Although it is desirable that the surface developer should not contain any silver halide solvent, it is permissible to add a silver halide solvent (e.g., sulfites) to the surface developer to such an extent that the internal latent image makes substantially no contribution to development prior to the completion of the development arising from surface development centers of silver halide grains.

The developer may contain as an alkali agent and a pH buffer, sodium hydroxide, potassium hydroxide, sodium carbonate, potassium carbonate, trisodium phosphate, sodium metaborate, etc. The contents of these agents are chosen so as to adjust the pH of the developer within the range of 9 to 13, preferably 10 to 11.2.

It is advantageous for the developer also to contain a compound generally used as antifoggant, for example, benzimidazoles such as 5-nitrobenzimidazole, or benzotriazoles such as benzotriazole, 5-methylbenzotriazole and the like, for the purpose of lowering the minimum density of the direct positive image.

When the photographic material of this invention is used as a film unit for the diffusion transfer process, it is desirable that the photographic material be processed with a viscous developer. Such a viscous developer is a liquid composition containing processing components necessary for the development of silver halide emulsions (and for the formation of diffusion transfer dye images). It contains water as a main solvent, and may optionally contain other hydrophilic solvents such as methanol, methyl cellosolve and the like. It is desirable that the processing composition contain a hydrophilic polymer, such as high molecular weight polyvinyl alcohol, hydroxyethyl cellulose, sodium carboxymethylcellulose, or so on. A good result can be obtained when these polymers are used in an amount as to impart a viscosity of at least 1 poise, preferably from 500 to 1,000 poise, at room temperature to the processing composition.

Such a processing composition is preferably used in such a condition that it is charged in a container rupturable by pressure, as disclosed in U.S. Pat. Nos. 2,543,181, 2,643,886, 2,653,732, 2,723,051, 3,056,491, 3,056,492 and 3,152,515, and so on.

This invention will now be illustrated in more detail by reference to the following examples. However, the invention should not be construed as being limited to these examples.

EXAMPLE 1

On the surface side of a paper support laminated with polyethylene on both sides were coated the layers described below, from the first to the fourteenth layers, in the order of description. On the back side of the support were coated the fifteenth and the sixteenth layers described below, in this order to prepare a multilayer color photographic material. The polyethylene laminate on the side of the first layer contained titanium oxide (4 g/m$^2$) as a white pigment and a slight amount (0.003 g/m$^2$) of bluish dye (ultramarine) (resulting in imparting to the support surface a chromaticity of 88.0, −0.20 and −0.75 expressed in the L*, a*, b* system).

The composition of each constituent layer and the coverage thereof (expressed in g/m$^2$) is described below. As for the silver halide emulsions and the colloidal silver, the figures on the right are the coverages based on silver. The emulsion used in each emulsion layer was prepared in accordance with the preparation method for Emulsion EM1 described below. However, in the fourth layer alone was used a Lippmann emulsion free of surface chemical sensitization.

| | |
|---|---|
| First Layer (antihalation layer) | |
| Black colloidal silver | 0.10 |
| Gelatin | 0.70 |
| Second Layer (interlayer) | |
| Gelatin | 0.70 |
| Third Layer (low red-sensitive layer) | |
| Silver bromide emulsion spectrally sensitized with red sensitizing dyes (ExS-1, 2 and 3) (having an average grain size of 0.25μ, a variation coefficient of 8% with respect to grainsize distribution, and an octahedral crystal form) | 0.04 |
| Silver chlorobromide emulsion spectrally sensitized with red sensitizing dyes (ExS-1, 2 and 3) (having a chloride content of 5 mol %, an average grain size of 0.40μ, a variation coefficient of 10% with respect to grain size distribution, and an octahedral crystal form) | 0.08 |
| Gelatin | 1.00 |
| Cyan coupler (1:1:0.2 mixture of ExC-1, 2 and 3) | 0.30 |
| Discoloration inhibitor (1:1:1:1 mixture of Cpd-1, 2, 3 and 4) | 0.18 |
| Stain inhibitor (Cpd-5) | 0.003 |
| Coupler dispersion medium (Cpd-6) | 0.03 |
| Coupler solvent (1:1:1 mixture of Sol-1, 2 and 3) | 0.12 |
| Fourth Layer (high red-sensitive layer) | |
| Silver bromide emulsion spectrally sensitized with red sensitizing dyes (ExS-1, 2 and 3) (having an average grain size of 0.60μ, a variation coefficient of 15% with respect to grain size distribution, and an octahedral crystal form) | 0.14 |
| Gelatin | 1.00 |
| Cyan coupler (1:1:0.2 mixture of ExC-1, 2 and 3) | 0.30 |
| Discoloration inhibitor (1:1:1:1 mixture of Cpd 1, 2, 3 and 4) | 0.18 |
| Coupler dispersion medium (Cpd-6) | 0.03 |
| Coupler solvent (1:1:1 mixture of Solv-1, 2 and 3) | 0.12 |
| Fifth Layer (interlayer) | |
| Gelatin | 1.00 |
| Color mixing inhibitor (Cpd-7) | 0.08 |
| Color mixing inhibitor solvent (1:1 mixture of Solv-4 and 5) | 0.16 |
| Polymer latex (Cpd-8) | 0.10 |
| Sixth Layer (low green-sensitive layer) | |
| Silver bromide emulsion spectrally sensitized with a green sensitizing dye (ExS-4) (having an average grain size of 0.25μ, a variation coefficient of 8% with respect to grain size distribution, and an octahedral crystal from) | 0.04 |
| Silver chlorobromide emulsion spectrally sensitized with a.green sensitizing dye (ExS-4) (having a chloride content of 5 mol %, an average grain size of 0.40μ, a variation coefficient of 10% with respect to grain size distribution, and an octahedral crystal form) | 0.06 |
| Gelatin | 0.80 |
| Magenta coupler (1:1:1 mixture of ExM-1, 2 and 3) | 0.11 |
| Discoloration inhibitor (1:1 mixture of Cpd-9 and 26) | 0.15 |
| Stain inhibitor (10:7:7:1 mixture of Cpd-10, 11, 12 and 13) | 0.025 |
| Coupler dispersion medium (Cpd-6) | 0.05 |
| Coupler solvent (1:1: mixture of Solv-4 and 6) | 0.15 |
| Seventh Layer (high green-sensitive layer) | |
| Silver bromide emulsion spectrally sensitized with a green sensitizing dye (ExS-4) (having an average grain size of 0.65μ, a variation coefficient of 16% with respect to grain size distribution, and an octahedral crystal form) | 0.10 |
| Gelatin | 0.80 |
| Magenta coupler (1:1:1 mixture of ExM-1, 2 and 3) | 0.11 |
| Discoloration inhibitor (1:1 mixture of Cpd-9 and 26) | 0.15 |
| Stain inhibitor (10:7:7:1 mixture of | 0.025 |

-continued

| | |
|---|---|
| Cpd-10, 11, 12 and 13) | |
| Coupler dispersion medium (Cpd-6) | 0.05 |
| Coupler solvent (1:1: mixture of Solv-4 and 6) | 0.15 |
| Eighth Layer (interlayer) | |
| The same as Fifth Layer | |
| Ninth Layer (yellow filter layer) | |
| Yellow colloidal silver (grain size: 100 Å | 0.12 |
| Gelatin | 0.70 |
| Color mixing inhibitor (Cpd-7) | 0.03 |
| Color mixing inhibitor solvent (1:1 mixture of Solv-4 and 5) | 0.10 |
| Polymer latex (Cpd-8) | 0.07 |
| Tenth Layer (interlayer) | |
| The same as Fifth Layer | |
| Eleventh Layer (low blue-sensitive layer) | |
| Silver bromide emulsion spectrally sensitized with blue sensitizing dyes (ExS-5 and 6) (having an average grain size of 0.40μ, a variation coefficient of 8% with respect to grain size distribution, and an octahedral crystal form) | 0.07 |
| Silver chlorobromide emulsion spectrally sensitized with green sensitizing dyes (ExS-5 and 6) (having a chloride content of 8 mol %, an average grain size of 0.60μ, a variation coefficient of 10% with respect to grain size distribution, and an octahedral crystal form) | 0.14 |
| Gelatin | 0.80 |
| Yellow coupler (1:1 mixture of ExY-1 and 2) | 0.37 |
| Discoloration inhibitor (Cpd-14) | 0.10 |
| Stain inhibitor (1:5 mixture of Cpd-5 and 15) | 0.007 |
| Coupler dispersion medium (Cpd-6) | 0.05 |
| Coupler solvent (Solv-2) | 0.10 |
| Twelfth Layer (high blue-sensitive layer) | |
| Silver bromide emulsion spectrally sensitized with blue sensitizing dyes (ExY-5 and 6) (having an average grain size of 0.85μ, a variation coefficient of 18% with respect to grain size distribution, and an octahedral crystal form) | 0.15 |
| Gelatin | 0.60 |
| Yellow coupler (1:1 mixture of ExY-1 and 2) | 0.32 |
| Discoloration inhibitor (Cpd-14) | 0.10 |
| Stain inhibitor (1:5 mixture of Cpd-5 and 15) | 0.007 |
| Coupler dispersion medium (Cpd-6) | 0.05 |
| Coupler solvent (Solv-2) | 0.10 |
| Thirteenth Layer (ultraviolet absorbing layer) | |
| Gelatin | 1.00 |
| Ultraviolet absorbent (1:1:1 mixture of Cpd-2, 4 and 16) | 0.50 |
| Color mixing inhibitor (1:1 mixture of Cpd-7 and 17) | 0.03 |
| Dispersion medium (Cpd-6) | 0.02 |
| Ultraviolet absorbent solvent (1:1 mixture of Solv-2 and 7) | 0.08 |
| Irradiation preventing dye (10:10:13:15:20 mixture of Cpd-18, 19, 20, 21 and 27) | 0.05 |
| Fourteenth Layer (protective layer) | |
| Fine-grain silver chlorobromide (chloride content: 97 mol %, average size: 0.1μ) | 0.03 |
| Acryl-modified copolymer of polyvinyl alcohol (molecular weight: 50,000) | 0.01 |
| 1:1 Mixture of polymethylmethacrylate particles (average particle size: 2.4μ) and silicon oxide (average grain size: 5μ) | 0.05 |
| Gelatin | 1.80 |
| Gelatin hardener (1:1 mixture of H-1 and H-2) | 0.18 |
| Fifteenth Layer (backing layer) | |
| Gelatin | 2.50 |
| Ultraviolet absorbent (1:1:1 mixture of Cpd-2, 4 and 16) | 0.50 |
| Dye (1:1:1:1:1 mixture of Cpd-18, 19, 20, 21 and 27) | 0.06 |
| Sixteenth Layer (back protecting layer) | |
| 1:1 Mixture of polymethylmethacrylate particles (average particle size: 2.4μ) and silicon oxide (average grain size: 5μ) | 0.05 |
| Gelatin | 2.00 |
| Gelatin hardener (1:1 mixture of H-1 and H-2) | 0.14 |

Preparation of Emulsion EM1

A water solution of potassium bromide and a water solution of silver nitrate were added simultaneously to a vigorously stirred water solution of gelatin over a 15-minute period as the temperature was kept at 75° to form octahedral silver bromide grains having an average grain size of 0.40 μm. In the course of grain formation, 3,4-dimethyl-1,1,3-thiazoline-2-thione was added in an amount of 0.3 g per mole of Ag. The obtained emulsion was admixed with successive 6 mg/mol Ag of sodium thiosulfate, and 7 mg/mol Ag of chloroauric acid (tetrahydrate), and heated for 80 min. at 75° C. to effect chemical sensitization. The thus obtained grains were utilized as core grains, and subjected to grain growth under the same condition as in the first precipitation operation to prepare finally a monodispersed core/shell type octahedral silver bromide emulsion having an average grain size of 0.7μ. The variation coefficient of grain size distribution was about 10%. This emulsion was admixed with 1.5 mg/mol Ag of sodium thiosulfate and 1.5 mg/mol Ag of chloroauric acid (tetrahydrate), and heated for 60 min. at 60° C. to effect chemical sensitization. Thus, an internal latent-image type silver halide emulsion was prepared.

In each light-sensitive layer, one of the nucleating agents set forth in Table 1 was incorporated in a proportion of $5\times10^{-3}$ wt % to silver halide, and Cpd-12 as a nucleation accelerator in a proportion of $10^{-2}$ wt % to silver halide. In addition, each light-sensitive layer contained Alkanol XC (products of DuPont) and sodium alkylbenzenesulfonate as emulsifying dispersion assistants, and a succinic acid ester and Magefac F120 (products of Dainippon .Ink & Chemicals, Inc.) as coating aids. In each layer containing silver halide or colloidal silver, Cpd-23, 24 and 25 were used as stabilizer.

The compounds used in this example are illustrated below.

ExS-1

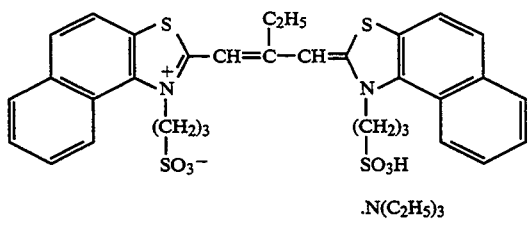

-continued
ExS-2
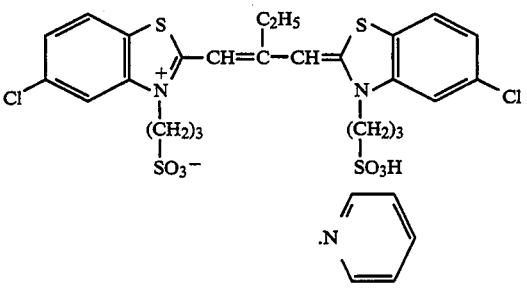
ExS-3
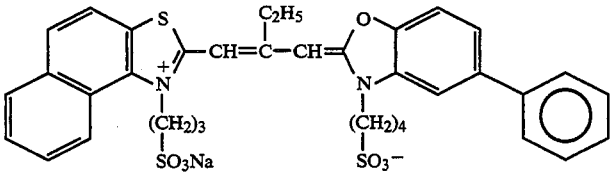
ExS-4
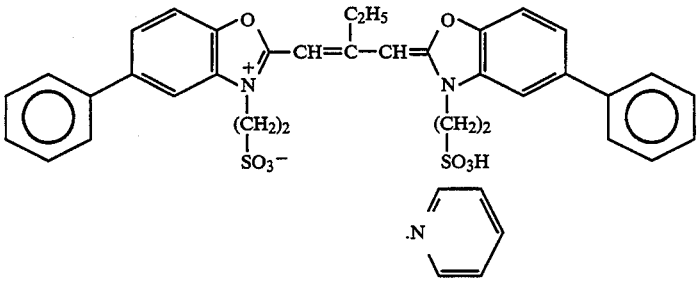
ExS-5
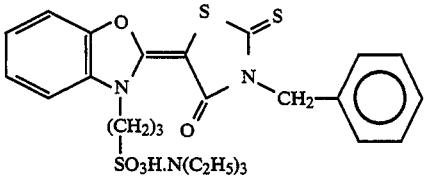
ExS-6
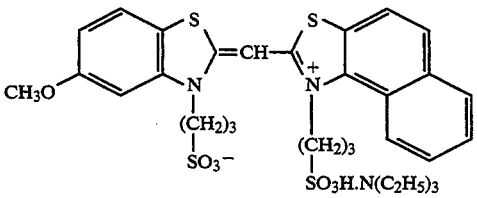
Cpd-1
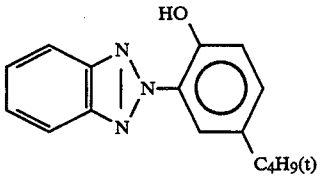
Cpd-2
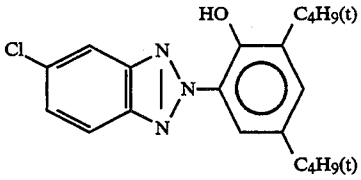

-continued
Cpd-3
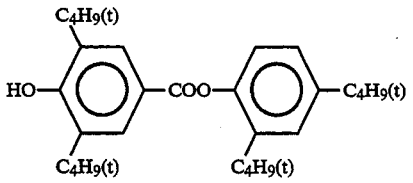
Cpd-4
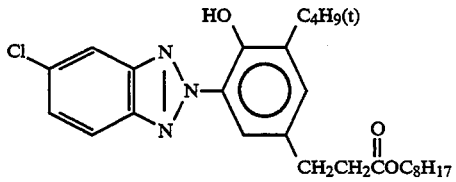
Cpd-5
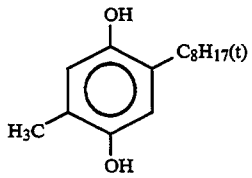
Cpd-6
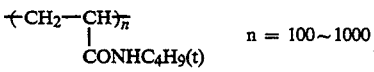
Cpd-7
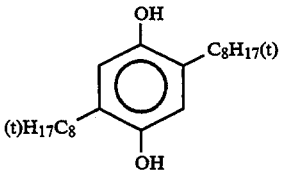
Cpd-8
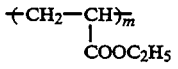
Cpd-9
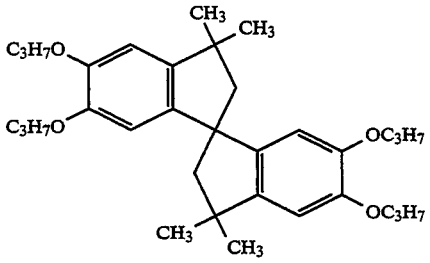
Cpd-10
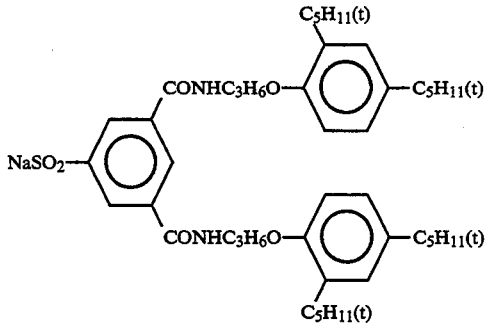

-continued
Cpd-11
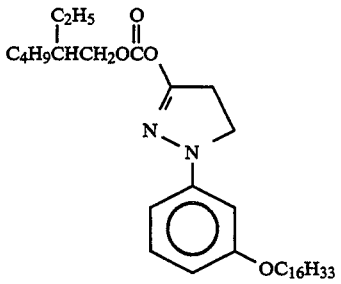
Cpd-12
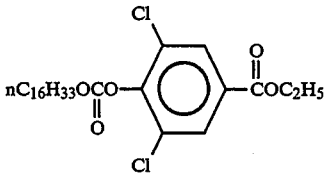
Cpd-13
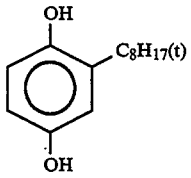
Cpd-14
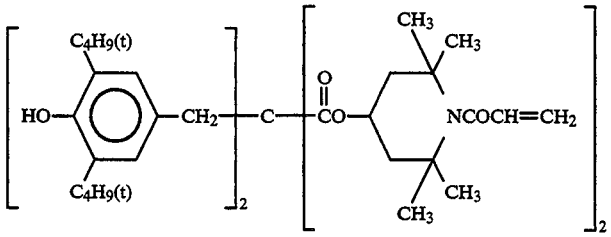
Cpd-15
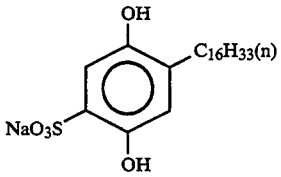
Cpd-16
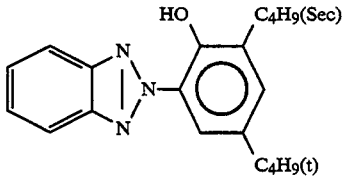
Cpd-17
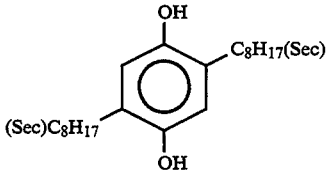
Cpd-18
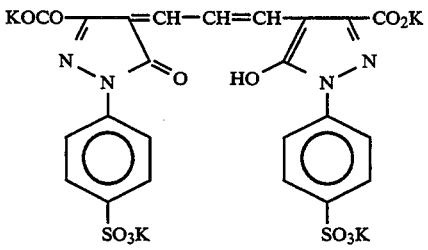

-continued
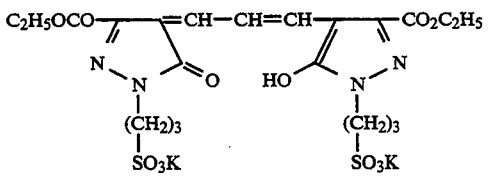
Cpd-19
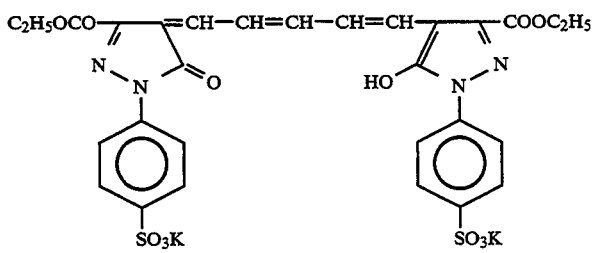
Cpd-20
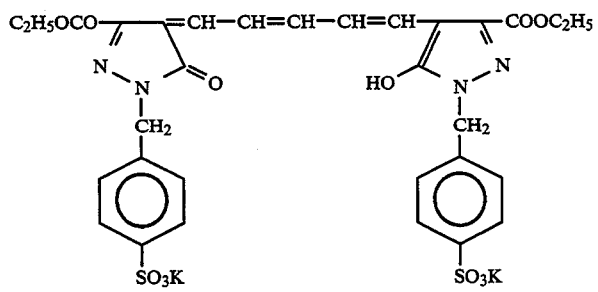
Cpd-21
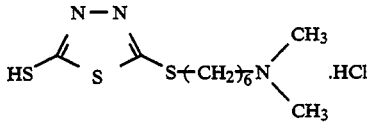
Cpd-22
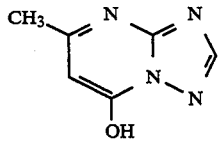
Cpd-23
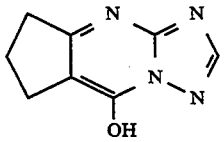
Cpd-24
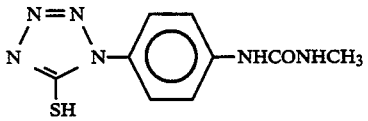
Cpd-25
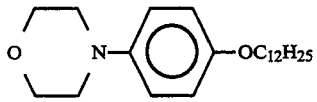
Cpd-26
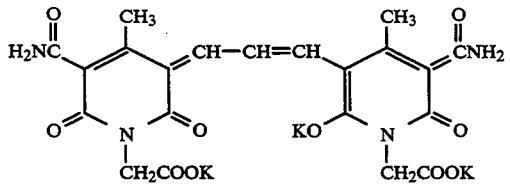
Cpd-27

-continued
EXC-1
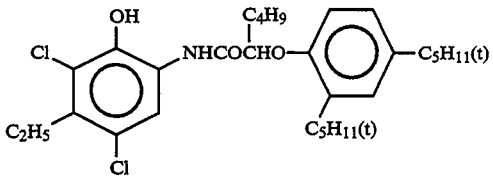
EXC-2
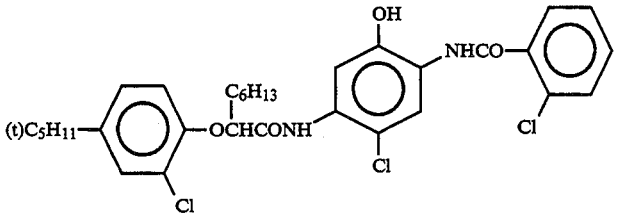
EXC-3
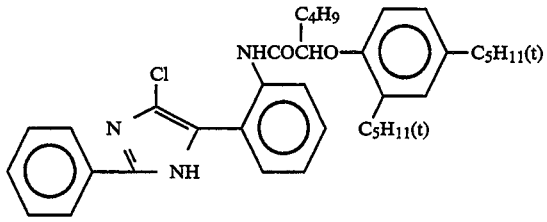
EXM-1
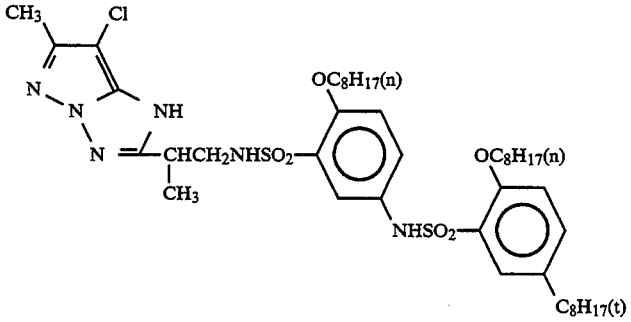
EXM-2
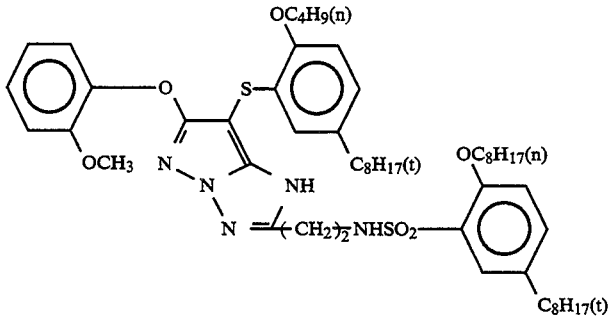
EXM-3
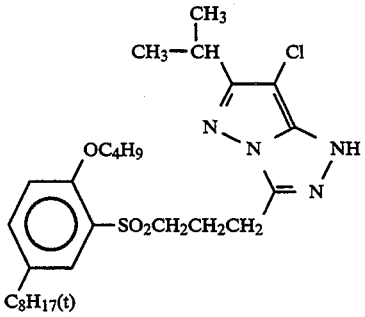

-continued

EXY-1

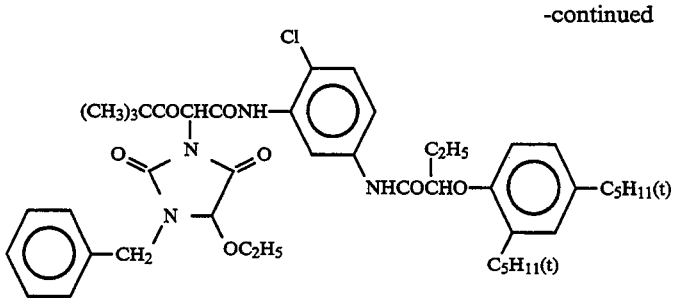

EXY-2

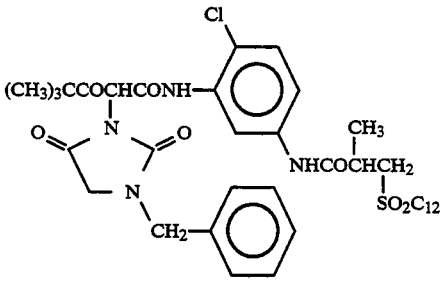

Solv-1 Di(2-ethylhexyl) sebacate
Solv-2 Trinonyl phosphate
Solv-3 Di(3-methylhexyl) phthalate
Solv-4 Tricresyl phosphate
Solv-5 Dibutyl phthalate
Solv-6 Trioctyl phosphate
Solv-7 Di(2-ethylhexyl) phthalate
H-1 1,2-Bis(vinylsulfonylacetamido)ethane
H-2 Sodium salt of 4,6-dichloro-2-hydroxy-1,3,5-triazine After each of the thus prepared silver halide color photographic materials was stored for 2 days at 40° C. -80% RH (for incubation), it was subjected to wedgewise exposure (1/10 sec., 10 CMS, color temperature of 3,200° K.), and then to a continuous photographic processing by an automatic developing machine under the conditions described below until an accumulated amount of each replenisher became three times the volume of the processing tank used.

| Processing Step | Time | Temperature | Tank Volume | Amount replenished |
|---|---|---|---|---|
| Color development | 135 sec. | 38° C. | 15 l | 300 ml/m$^2$ |
| Bleach-fix | 40 sec. | 33° C. | 3 l | 300 ml/m$^2$ |
| Washing (1) | 40 sec. | 33° C. | 3 l | — |
| Washing (2) | 40 sec. | 33° C. | 3 l | 320 ml/m$^2$ |
| Drying | 30 sec. | 80° C. | | |

The washing processing was carried out according to a countercurrent process in which the washing bath (2) was replenished with water, and the water overflowing the washing bath (2) was introduced into the washing bath (1). In this processing, the amount of the bleach-fix solution brought by the photographic material from the bleach-fix bath into the washing bath (1) was 35 ml/m$^2$, and the amount of the replenished water was 9.1 times the amount of the bleach-fix solution brought.

The composition of each processing solution used is described below.

| | Tank Solution | Replenisher |
|---|---|---|
| Color Developer: | | |
| D-sorbitol | 0.15 g | 0.20 g |
| Sodium naphthalenesulfonate-formaldehyde condensate | 0.15 g | 0.20 g |
| Ethylenediaminetetrakis methylenephosphonic acid | 0.15 g | 0.15 g |
| Diethylene glycol | 12.0 ml | 16.0 ml |
| Benzyl alcohol | 13.5 ml | 18.0 ml |
| Potassium bromide | 0.85 g | — |
| Benzotriazole | 0.003 ml | 0.004 ml |
| Sodium sulfite | 2.4 g | 3.2 g |
| N,N-Bis(carboxymethyl)-hydrazine | 6.0 g | 8.0 g |
| D-glucose | 2.0 g | 2.4 g |
| Triethanolamine | 6.0 g | 8.0 g |
| N-ethyl-N-(β-methanesulfonamidoethyl)-3-methyl-4-aminoaniline sulfate | 6.4 g | 8.5 g |
| Potassium carbonate | 30.0 g | 25.0 g |
| Brightening agent (diaminostilbene type) | 1.0 g | 1.2 g |
| Water to make | 1000 ml | 1000 ml |
| pH (25° C.) adjusted to | 10.25 | 10.75 |
| Bleach Fix Bath (Tank solution = Replenisher): | | |
| Disodium ethylenediaminetetraacetate dihydrate | | 4.0 g |
| Ammonium ethylenediaminetetraacetatoferrate (III) dihydrate | | 70.0 g |
| Ammonium thiosulfate (700 g/l) | | 180 ml |
| Sodium p-toluenesulfinate | | 20.0 g |
| Sodium hydrogen sulfite | | 20.0 g |
| 5 Mercapto-1,3,4-triazole | | 0.5 g |
| Ammonium nitrate | | 10.0 g |
| Water to make | | 1000 ml |
| pH (25° C.) | | 6.20 |

Washing Bath (Tank solution=Replenisher)

Tap water was passed through a column of mixed-bed system in which H-type strong acid cation-exchange resin (Amberlite IR-120B, produced by Rhom & Haas Co.) and OH-type anion-exchange resin (Amberlite IR-400, produced by Rhom & Haas Co.) were charged, resulting in reduction of calcium and magnesium ion concentrations to 3 mg/l or less. To the thus purified water were added 20 mg/l of sodium dichloroisocyanurate and 1.5 g/l of sodium sulfate. The pH of this solution was within the range of 6.5 to 7.5.

The thus development-processed samples were examined for maximum and minimum densities (Dmax and Dmin) of then developed magenta color images. The results obtained are shown in Table 1.

TABLE 1

| Sample No. | Nucleating Agent | Before Incubation Dmax | Before Incubation Dmin | After Incubation Dmax | After Incubation Dmin | Note |
|---|---|---|---|---|---|---|
| 101 | absent | 0.16 | 0.09 | 0.17 | 0.10 | Comparison |
| 102 | Compound A | 2.1 | 0.13 | 1.5 | 0.14 | " |
| 103 | Compound 1 | 2.2 | 0.11 | 2.0 | 0.12 | This invention |
| 104 | Compound 2 | 2.3 | 0.11 | 2.2 | 0.12 | " |
| 105 | Compound 3 | 2.2 | 0.12 | 2.1 | 0.12 | " |
| 106 | Compound 7 | 2.4 | 0.11 | 2.1 | 0.12 | " |
| 107 | Compound 8 | 2.2 | 0.11 | 2.0 | 0.12 | " |
| 108 | Compound 9 | 2.1 | 0.11 | 1.9 | 0.12 | " |
| 109 | Compound 13 | 2.3 | 0.12 | 2.1 | 0.12 | " |

Compound A (for Comparison)

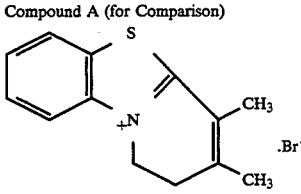

(disclosed in JP-B-52-47326)

As can be seen from the results of Table 1, Sample Nos. 103 to 109, which each contains the nucleating agent of this invention, had the advantage that low Dmin and high Dmax were achieved, compared with Comparative Sample Nos. 101 and 102. In addition, the samples of this invention had another advantage in that lowering of Dmax due to incubation was hardly caused therein.

A direct positive image having high Dmax and low Dmin can be obtained by the use of the nucleating agent of this invention. Even when the photographic materials containing the nucleating agent of this invention were development-processed after storage under high temperature and/or high humidity, they showed only a slight decrease in Dmax and only a slight increase in Dmin compared with the case in which they were development-processed just after the production.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide photographic emulsion layer and one hydrophilic colloid layer, which contains at least one nitrogen-containing heterocyclic ring compound having a charge represented by formula (I) in said emulsion layer or in a hydrophilic colloid layer adjacent thereto:

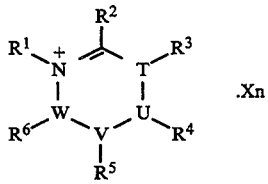

(I)

wherein T, U, V and W each represents CH or N and the nitrogen-containing heterocyclic ring completed by T, U, V, and W contains 1 to 3 nitrogen atoms; $R^1$ represents a substituent group; $R^2$, $R^3$, $R^4$, $R^5$ and $R^6$ each represents a hydrogen atom or a substituent group, provided that at least one of $R^2$ to $R^6$ represents a group to be eliminated under an alkaline condition; X represents a counter ion for balancing charge; n represents the number of counter ions necessary for balancing said charge; and any pair of adjacent groups of $R^1$ to $R^6$ may combine with each other to form a ring.

2. The silver halide photographic material of claim 1, wherein said layer containing said compound is an internal latent image silver halide photographic emulsion layer.

3. The silver halide photographic material of claim 1, wherein said layer containing said compound is a surface latent image silver halide photographic emulsion layer.

4. The silver halide photographic material of claim 1, wherein at least one of $R^1$ to $R^6$ substituents contains a moiety capable of promoting adsorption of the compound to silver halide grains.

5. The silver halide photographic material of claim 4, wherein the moiety capable of promoting adsorption of the compound to silver halide grains is represented by the following formula (II):

$$Y-(L)_m- \quad \text{(II)}$$

wherein Y represents a thioamido group, a mercapto group or a 5- or 6-membered nitrogen-containing heterocyclic group, L represents a linkage group, and m represents 0 or 1.

6. The silver halide photographic material of claim 5, wherein the thioamido moiety capable of promoting adsorption of the compound to silver halide grains is represented by the following formula (III):

$$R^7-E-\overset{\overset{\displaystyle S}{\|}}{C}-E'- \quad \text{(III)}$$

wherein either E or E' represents —N($R^8$)—, and the other represents —O—, —S—, or —N($R^9$)—; $R^7$ represents a hydrogen atom, or an aliphatic group, or it combines with E or E' to complete a 5- or 6-membered heterocyclic ring; and $R^8$and $R^9$ each represents a hydrogen atom, or an aliphatic or aromatic group.

7. The silver halide photographic material of claim 1, wherein T, U, V and W are all CH.

8. The silver halide photographic material of claim 1, wherein either $R^4$ and $R^5$ contains a group which is capable of being eliminated under an alkaline condition.

9. The silver halide photographic material of claim 1, wherein $R^1$ and $R^2$ combine with each other to form a 5- to 7-membered nitrogen-containing heterocyclic ring.

10. The silver halide photographic material of claim 1, wherein at least one of the substituent groups from $R^1$ to $R^6$ contains a group capable of accelerating adsorption to silver halide grains.

11. The silver halide photographic material of claim 1, wherein said substituent group of $R^1$ is selected from the group consisting of an alkyl, alkenyl, alkynyl, aralkyl, aromatic, hydroxyl, aliphatic oxy, aromatic oxy, halogen atom, amino, substituted amino, aliphatic thio, aromatic thio, acyloxy, sulfonyloxy, acylamino, sulfonylamino, carboxyl, aliphatic oxycarbonyl, aromatic oxycarbonyl, acyl, carbamoyl, N-substituted carbamoyl, sulfamoyl, N-substituted sulfamoyl, sulfo, cyano, ureido, substituted ureido, substituted urethane, carbonic acid ester, and substituted or unsubstituted imino group.

12. The silver halide photographic material of claim 1, wherein said substituent group of $R^2$ to $R^6$ is selected from the group consisting of an alkyl, alkenyl, alkynyl, aralkyl, aromatic, hydroxyl, aliphatic oxy, aromatic oxy, halogen atom, amino, substituted amino, aliphatic thio, aromatic thio, acyloxy, sulfonyloxy, acylamino , sulfonyl amino, carboxyl, aliphatic oxycarbonyl, aromatic oxycarbonyl, acyl, carbamoyl, N-substituted carbamoyl , sulfamoyl, N-substituted sulfamoyl, sulfo, cyano, ureido, substituted ureido, substituted urethane, carbonic acid ester, and substituted or unsubstituted imino group.

13. The silver halide photographic material of claim 1, wherein the amount of said compound is from about $1\times10^{-8}$ to about $1\times10^{-2}$ mole per mole of silver.

* * * * *